US011627761B2

(12) United States Patent
Huang

(10) Patent No.: US 11,627,761 B2
(45) Date of Patent: Apr. 18, 2023

(54) VAPING DEVICE

(71) Applicant: Cloudious9 Inc., Freemont, CA (US)

(72) Inventor: Richard Yao Tien Huang, Freemont, CA (US)

( * ) Notice: Subject to any disclaimer, the term of this patent is extended or adjusted under 35 U.S.C. 154(b) by 691 days.

(21) Appl. No.: 16/538,651

(22) Filed: Aug. 12, 2019

(65) Prior Publication Data

US 2021/0022410 A1 Jan. 28, 2021

Related U.S. Application Data

(63) Continuation-in-part of application No. 29/698,999, filed on Jul. 22, 2019, now Pat. No. Des. 924,474.

(51) Int. Cl.

| | |
|---|---|
| ***A24F 7/00*** | (2006.01) |
| ***H05B 3/06*** | (2006.01) |
| ***A24F 40/485*** | (2020.01) |
| ***A24F 40/46*** | (2020.01) |
| ***A24F 40/20*** | (2020.01) |

(52) U.S. Cl.
CPC ..... *A24F 7/00* (2013.01); *A24F 40/46* (2020.01); *A24F 40/485* (2020.01); *H05B 3/06* (2013.01); *A24F 40/20* (2020.01)

(58) Field of Classification Search
CPC ..... A24F 40/20; A24F 40/40; A24F 40/46; A24F 40/42; A24F 42/60
See application file for complete search history.

(56) References Cited

U.S. PATENT DOCUMENTS

| | | | | |
|---|---|---|---|---|
| 9,681,688 | B1 | 6/2017 | Rinehart et al. | |
| 10,021,910 | B2 | 7/2018 | Gavrielov et al. | |
| 2015/0053220 | A1* | 2/2015 | Levy | A24F 40/485 131/329 |
| 2015/0272211 | A1* | 10/2015 | Chung | A24F 40/40 206/242 |
| 2016/0120224 | A1 | 5/2016 | Mishra et al. | |
| 2017/0055588 | A1* | 3/2017 | Cameron | A61M 15/06 |
| 2017/0172205 | A1 | 6/2017 | Chang et al. | |
| 2017/0295845 | A1* | 10/2017 | Bajpai | A61M 11/042 |
| 2017/0360100 | A1* | 12/2017 | Duc | H05B 3/265 |
| 2018/0085551 | A1* | 3/2018 | Krietzman | H05B 1/0252 |
| 2019/0001086 | A1 | 1/2019 | Garthaffner et al. | |
| 2019/0090539 | A1 | 3/2019 | Rostami et al. | |
| 2019/0116884 | A1 | 4/2019 | Conley et al. | |
| 2019/0183182 | A1 | 6/2019 | Tucker et al. | |
| 2021/0112878 | A1* | 4/2021 | Ruscio | A24F 40/46 |
| 2021/0219618 | A1* | 7/2021 | Fernando | A24F 40/42 |

FOREIGN PATENT DOCUMENTS

| | | | | |
|---|---|---|---|---|
| WO | WO-2013102609 | A2 * | 7/2013 | A24D 1/14 |
| WO | WO-2019121811 | A1 * | 6/2019 | A24F 40/20 |

* cited by examiner

*Primary Examiner* — Kelly M Gambetta
*Assistant Examiner* — Stephanie Lynn Moore
(74) *Attorney, Agent, or Firm* — Olav M. Underdal; IDP Patent Service

(57) ABSTRACT

A vaping device includes: a main body with a heating chamber, an air entry aperture, a vapor exit aperture, a heating canal, a herb loading shovel with a sliding knob, a residue tray; a mouthpiece with a vapor exit aperture, a vapor canal, a vapor cooler; such that a herb material is insertable into an interior of the heating chamber, such that the herb material is heated by the heating element, such that a vapor is produced by the herb material, and such that an external surface of the heating chamber is heated; such that the air is heated from a convective heat emitted by the external surface of the heating chamber.

18 Claims, 19 Drawing Sheets

Vaping Device

Vaping Device

Vaping Device Control System

Vaping Device Control Unit

VAPING DEVICE

CROSS-REFERENCE TO RELATED APPLICATIONS

This application is a continuation-in-part of U.S. Design application No. 29/698,999, filed Jul. 22, 2019; which is hereby incorporated herein by reference in its entirety.

FIELD OF THE INVENTION

The present invention relates generally to the field of vaping devices for herbs, including vaping devices for tobacco and cannabis materials, and more particularly to methods and systems for vaping devices, which are adapted to receive ground material and perform efficient heating of the ground material.

BACKGROUND OF THE INVENTION

Vaping devices are well-known for use in smoking materials, such as cannabis and tobacco.

However, conventional vaping devices typically do not provide convenient means for filling an interior of a vaping device with ground smoking material.

Further, conventional vaping devices for use with ground smoking material provide inefficient heating of the ground smoking material.

Conventional conduction vaping devices have a heating chamber, which is heated by direct radiation. Herb are placed in this heating chamber and vaporized. Usually the external layer of such heating chamber is covered with heat resistant material to prevent the heat from transferring to the external casing of a vaporizer. The internal chamber's heat is used to vaporize herbs deposited in the heating chamber. However, a recurring problem with such conduction vaporizers is that when a user inhales for too long, the chamber air is replaced with incoming cool air and eventually it is no longer hot and vaporization of the herbs stops. Even so, this method consumes less power and can make the vaporizer smaller.

In another approach, conventional convection vaping devices use a convection heating method, wherein incoming cool air passes through a long heated path, which is usually swiveling to increase the time of exposure to heat, such that when the heated air arrives at the chamber it is already hot. This ensures the heat is consistent and eliminates the problems of conduction vaporizers. However, such conventional convection vaping devices usually requires a long rod to be heated and thereby require higher power consumption. Further, such devices will typically be relatively large, to fit the long heated rod and large-size batteries, and will therefore also be relatively expensive.

As such, considering the foregoing, it may be appreciated that there continues to be a need for novel and improved devices and methods for vaping devices.

SUMMARY OF THE INVENTION

The foregoing needs are met, to a great extent, by the present invention, wherein in aspects of this invention, enhancements are provided to the existing model of vaping devices.

In an aspect, a vaping device can include:

a main body, which comprises:

a heating chamber, which can include a heating element, such that a herb material can be insertable into the heating chamber, such that the herb material can be heated by the heating element, such that a vapor is produced by the herb material, and such that an external surface of the heating chamber is heated; and an air entry aperture, which can be positioned on a surface of the main body;

a vapor exit aperture;

a heating canal, which is connected in a first end to the air entry aperture and in a second end to a lower part of the heating chamber, such that the heating canal is configured to spiral around the heating chamber;

such that air is configured to enter via the air entry aperture, pass through via the heating canal and the heating chamber, and exit via the vapor exit aperture, when a user inhales from the vapor exit aperture.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
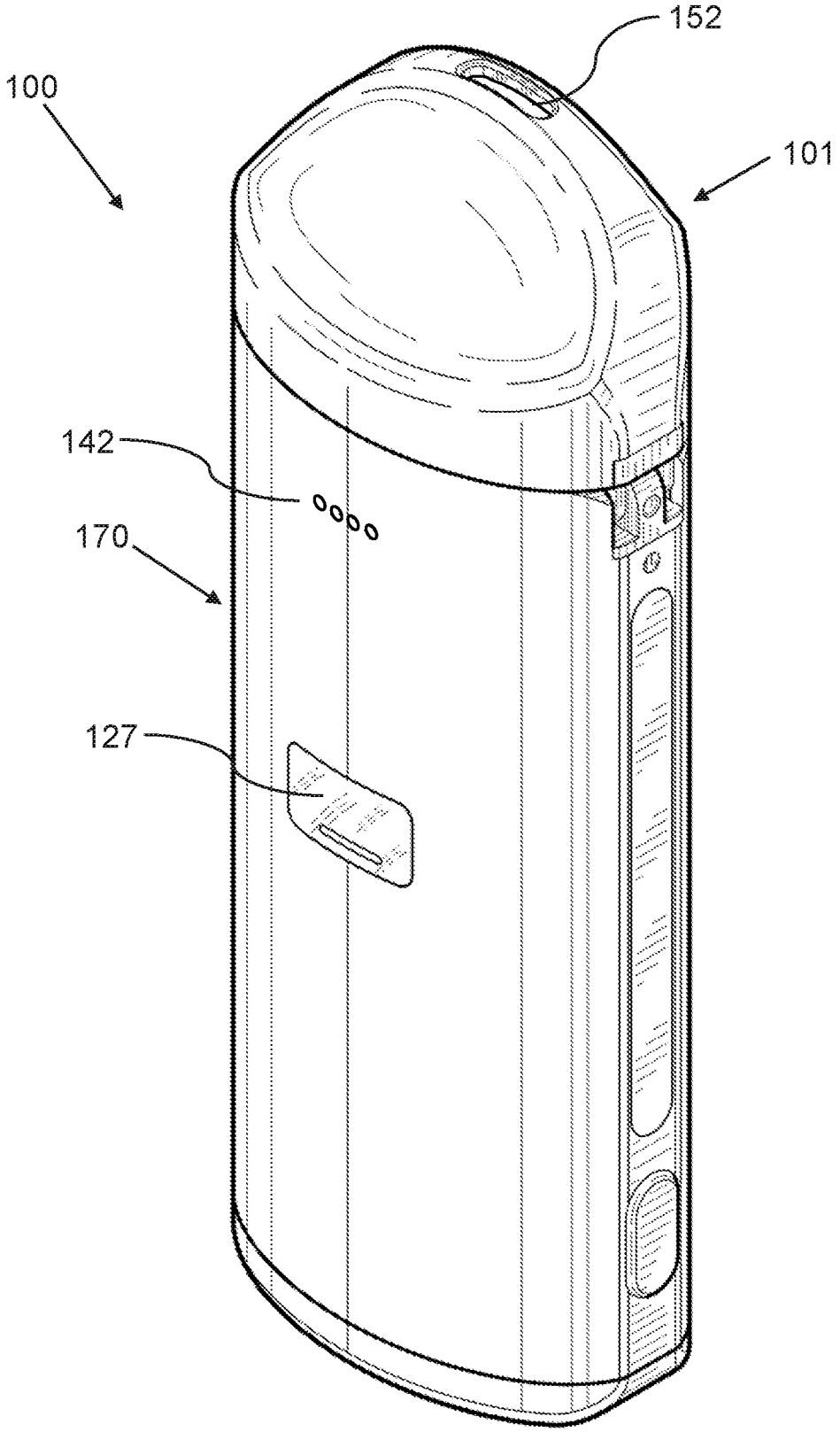
FIG. 1A is a top perspective view of a vaping device with a mouthpiece in a closed configuration, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a vaping device 100 with reference to FIG. 1A, in such manner that like reference numerals refer to like components throughout; a convention that we shall employ for the remainder of this specification.

Figure 7A:
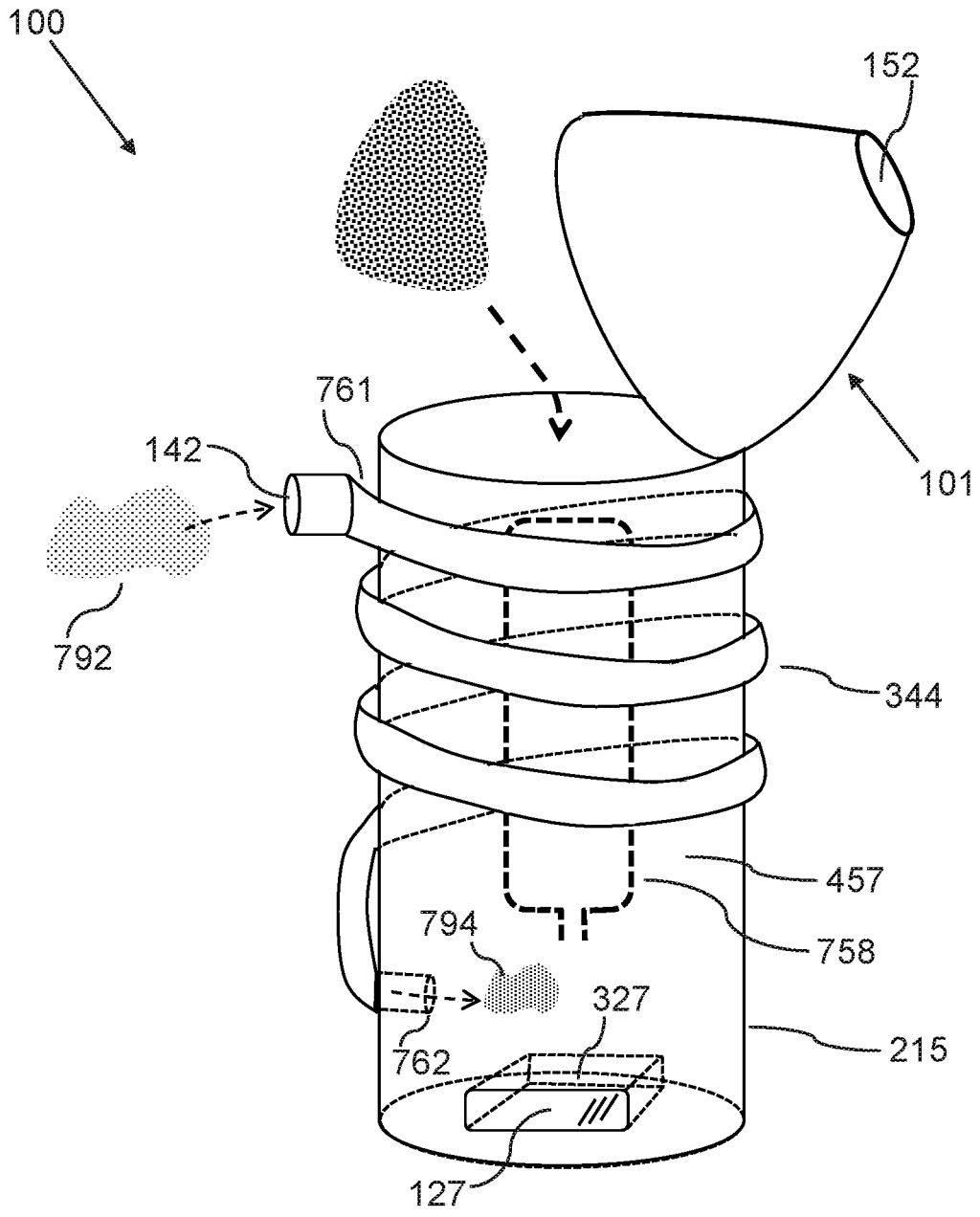
FIG. 7A is a schematic diagram of the vaping device shown in FIG. 1A, with a mouthpiece in an open configuration, according to an embodiment of the invention.
Figure 7B:
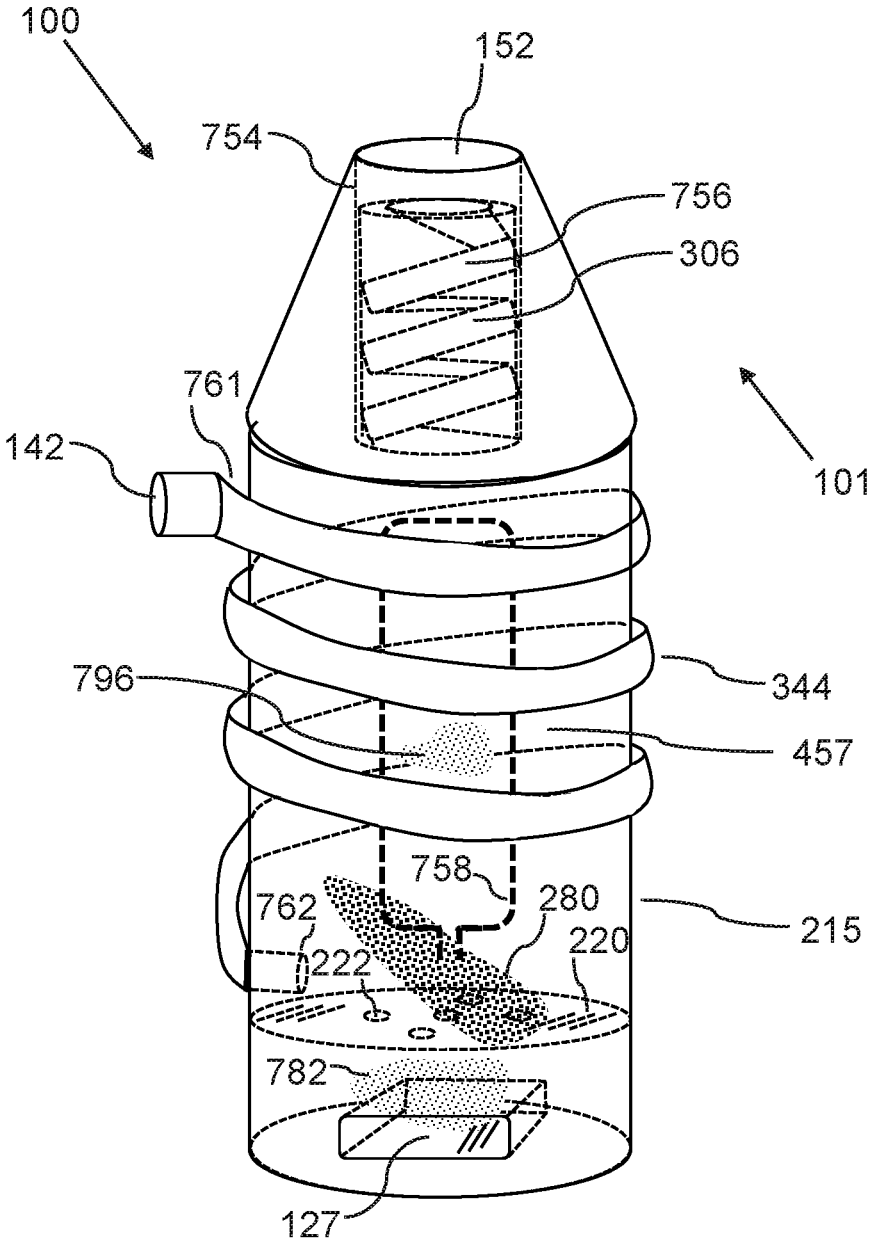
FIG. 7B is a schematic diagram of the vaping device shown in FIG. 1A, with a mouthpiece in a closed configuration, according to an embodiment of the invention.

In an embodiment, as shown in FIGS. 1A-1D, 2A-2D, 3, and 7A-7B, a vaping device 100 can include:

a) A main body 170, which comprises:

i. a heating chamber 215, which comprises:

a heating interior 457 of the heating chamber 215; and a heating element 758, which can be incorporated in a wall of the heating chamber 215, as shown in FIGS. 7A and 7B; such that a herb material 280 is insertable into the heating interior 457 of the heating chamber 215, such that the herb material 280 is heated by the heating element 758, such that a vapor is produced by the herb material 280, and such that an external surface of the heating chamber is heated by the heating element 758;

ii. an air entry aperture 142, which is positioned on a surface of the main body 170 of the vaping device 100;

iii. a heating canal 344, which is connected in a first end 761 to the air entry aperture 142 and in a second end 762 to a lower part of the heating chamber 215, such that the heating canal 344 is helix-shaped, such that the heating canal 344 is configured to spiral around the heating chamber, whereby ambient air 792 being drawn in through the air entry aperture 142 is heated in the heating canal 344 and emitted as heated air 794 from the second end of the heating canal 344 into the heating chamber 215;

b) A mouthpiece 101, which can be hingedly connected to a top of the main body, wherein the mouthpiece 101 comprises:

i. a vapor exit aperture 152, which is positioned on a surface of the mouthpiece of the of the vaping device 100, such that the vapor exit aperture 152 is fluidly connected to the heating interior 457 of the heating chamber 215;

ii. a vapor canal 754, such that the vapor exit aperture 152 is fluidly connected with the vapor canal 754, and such that the vapor canal is fluidly connected to the heating interior 457 of the heating chamber 215;

iii. a vapor cooler 306 (also called a vapor buffer 306), which is inserted in the vapor canal 754, such that the vapor cooler 306 comprises a cooling canal 756, such that vapor 796 from the heating chamber passes through the cooling canal 756, wherein the cooling canal 756 can be a helix-shaped (i.e. as an elongated spiral), to lengthen the cooling canal, such that the cooling canal cools the vapor;

wherein, when the mouthpiece 101 is opened, the heating chamber 215 is exposed, such that the herb material 280 can be inserted (i.e. is insertable) into the heating chamber;

wherein, when the mouthpiece 101 is closed, the vapor exit aperture 152 is fluidly connected to the air entry aperture 142, via the vapor canal 754, the cooling canal 756, and the heating canal 344;

such that the herb material 280 is heated and vaporized by the heating element 758, such that vapor 796 from the herb material passes via the cooling canal and exits via the vapor exit aperture 152, when a user inhales from the vapor exit aperture 152 of the mouthpiece 101;

such that air 792 is configured to enter via the air entry aperture 142, pass through via the heating canal 344 and the heating chamber 215, and exit via the vapor exit aperture 152, when a user inhales from the vapor exit aperture 152;

such that the air 792 is heated from a convective heat emitted by the external surface of the heating chamber.

Thus, in various related embodiment, the vaping device 100 combines conduction and convection heating by making the intake air travel around the external wall of the heating chamber, effectively using the heat that previously was wasted in conduction heating as the heated rod of a convection heating vaporizer, such that the external heating canal 344 heats the air and the internal heating chamber 215 heats the herb material, whereby the vaping device 100 achieves both convection heating and conduction heating with the cost and size of a conventional conduction heating vaporizer.

Figure 3:
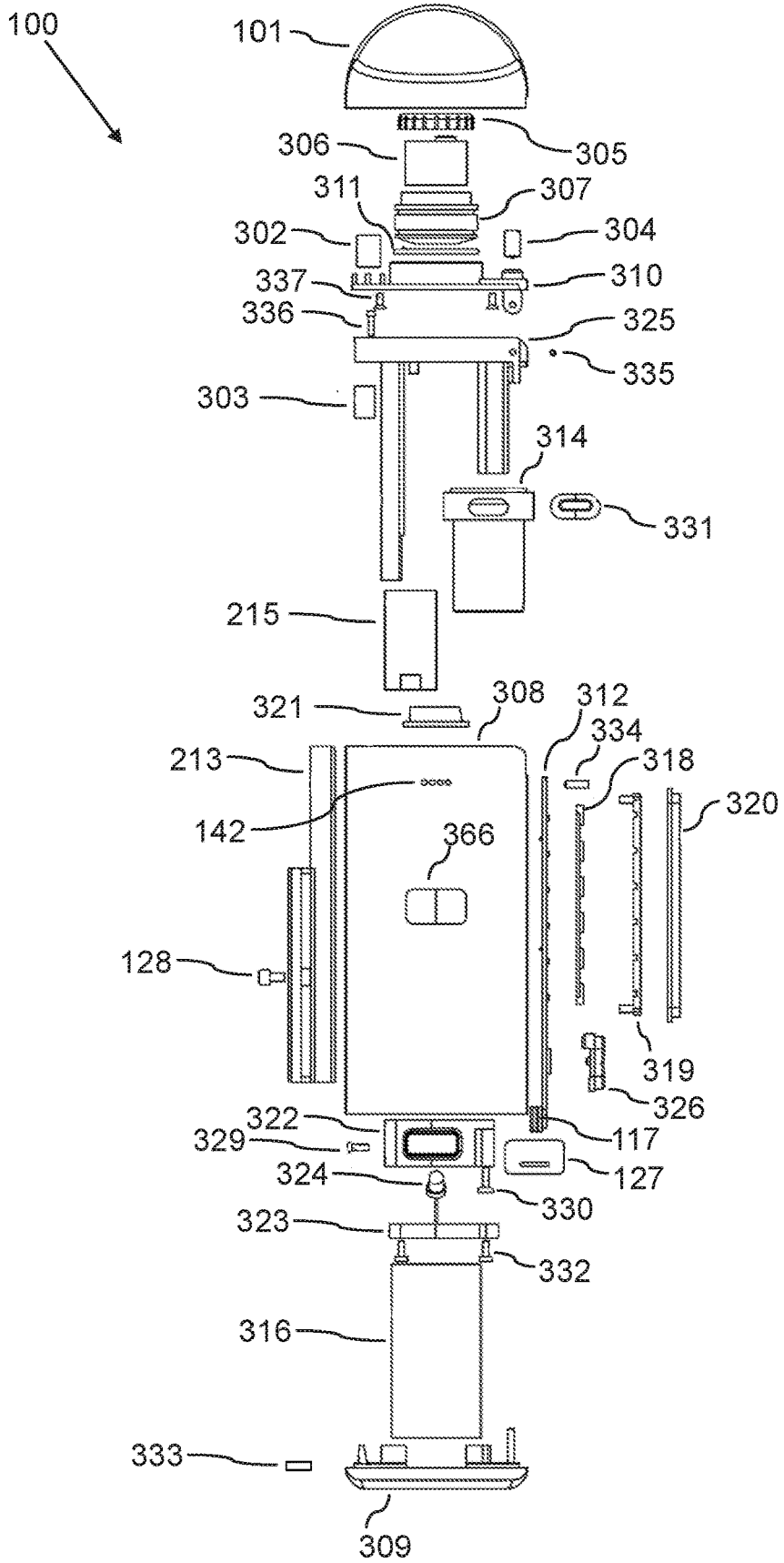
FIG. 3 is an exploded side view of a vaping device, according to an embodiment of the invention.
Figure 4:
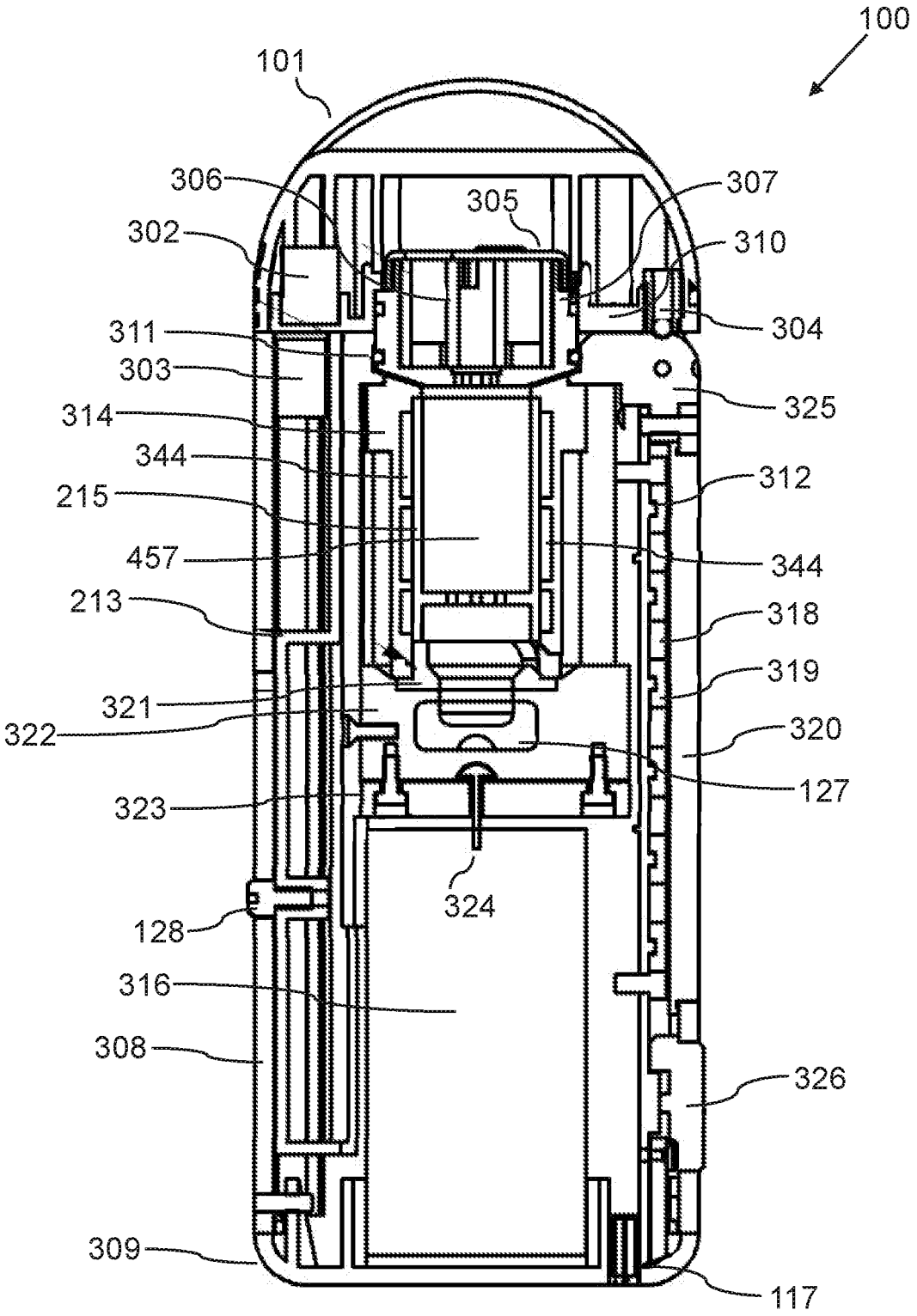
FIG. 4 is a cross-sectional side view of a vaping device, according to an embodiment of the invention.

In a related embodiment, as shown in FIGS. 3 and 4, the vaping device 100 can further include:

a) a heating chamber cover 314, which is configured to slide over the heating chamber 215, such that the heating chamber cover 314 is adjacent to an outer vertical surface of the heating chamber 215 and covers all or at least a part of the outer vertical surface of the heating chamber 215;

wherein an inner surface of the heating chamber cover 314 comprises an elongated indentation 344, such that the elongated indentation 344 forms the heating canal 344 between the inner surface of the heating chamber cover 314 and an outer surface of the heating chamber 215.

In a further related embodiment, as shown in FIGS. 3 and 4, the inner surface of the heating chamber can be tubular and shaped as an outer tube; and the outer surface of the heating chamber is tubular and shaped as an inner tube; such that the inner tube fits inside the outer tube.

Figure 2A:
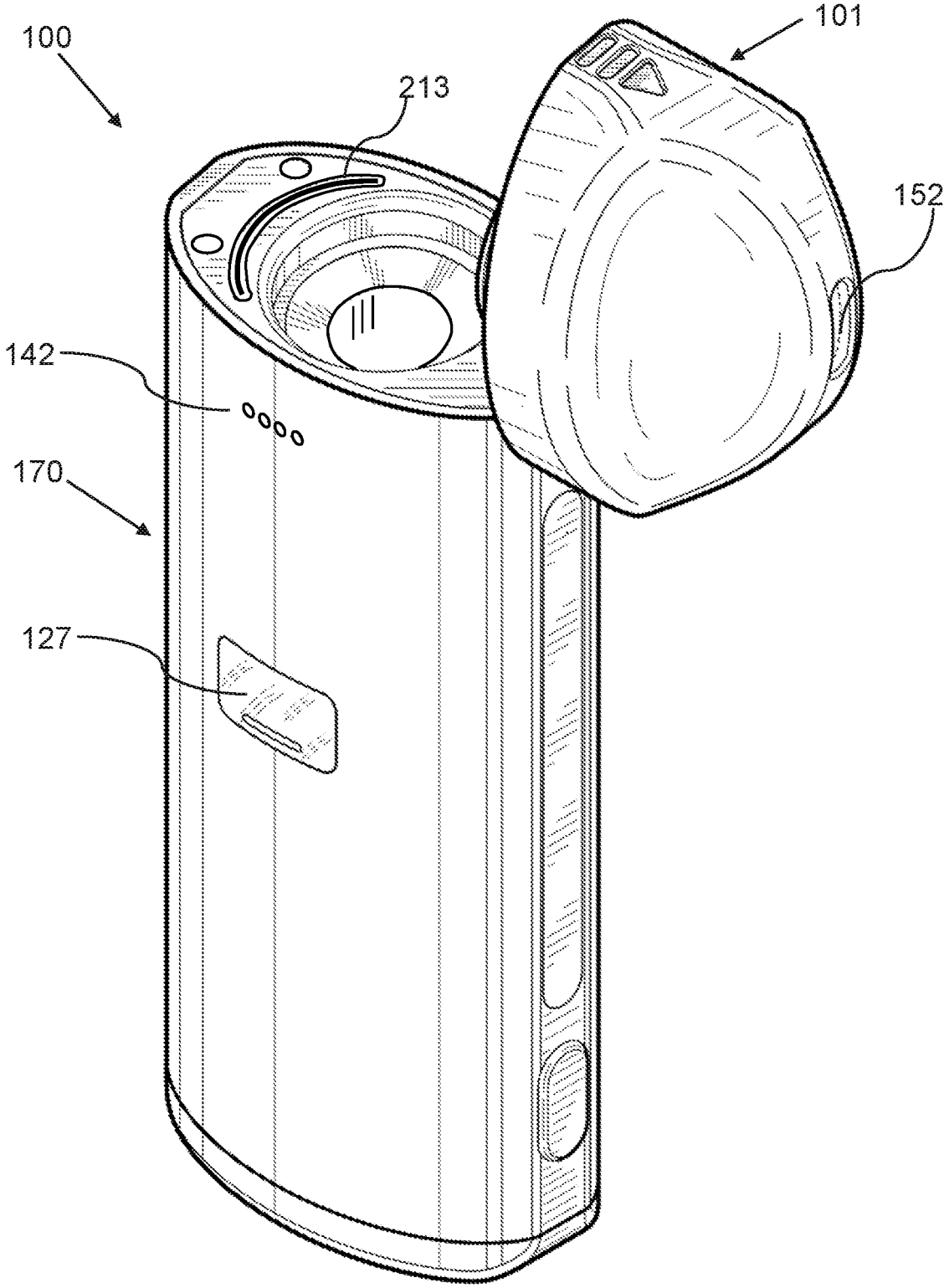
FIG. 2A is a top perspective view of a vaping device with a mouthpiece in an open configuration, according to an embodiment of the invention.
Figure 2B:
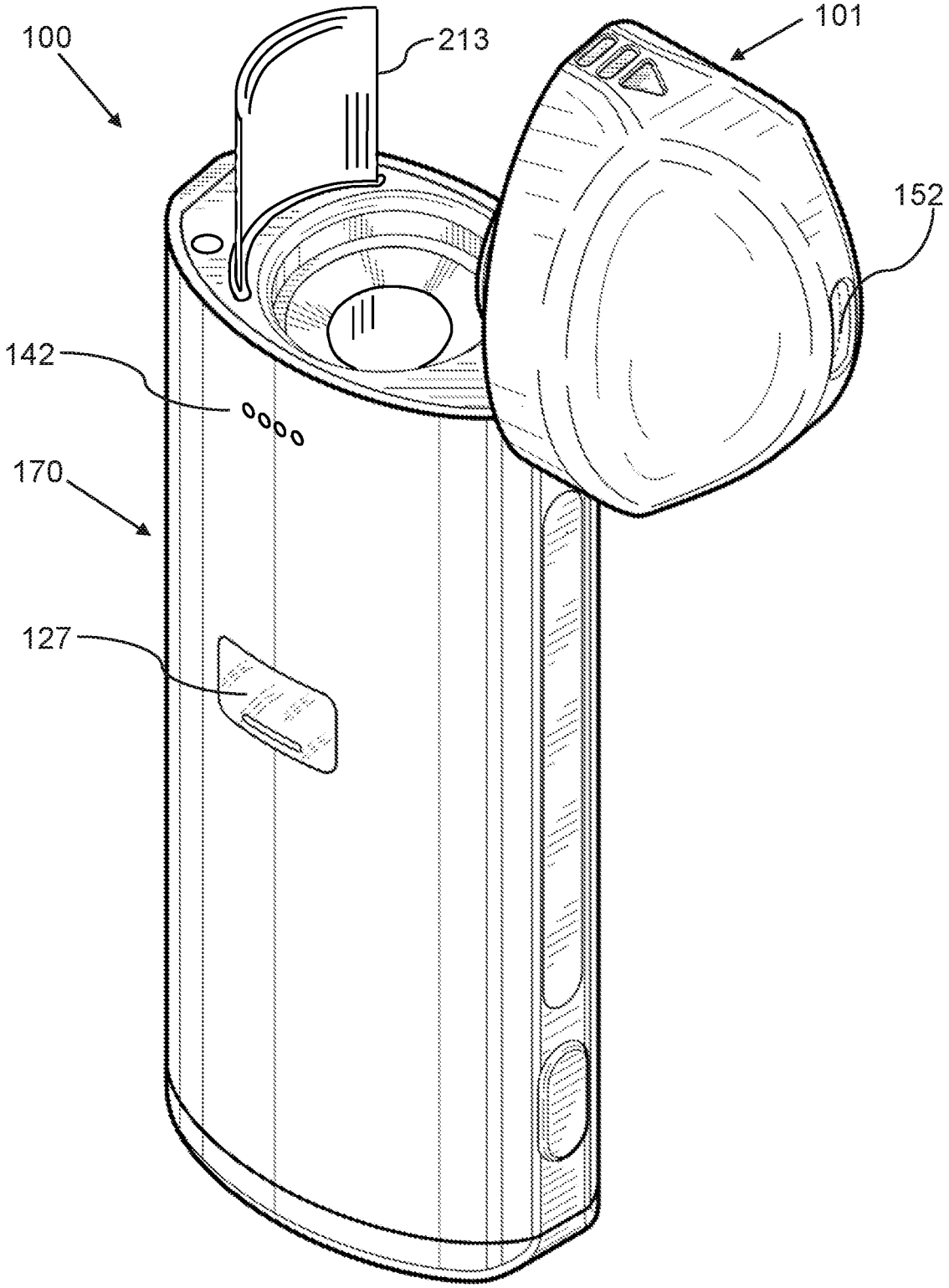
FIG. 2B is a top perspective view of a vaping device with a mouthpiece in an open configuration, showing a slidable shovel fully extended, according to an embodiment of the invention.
Figure 2C:
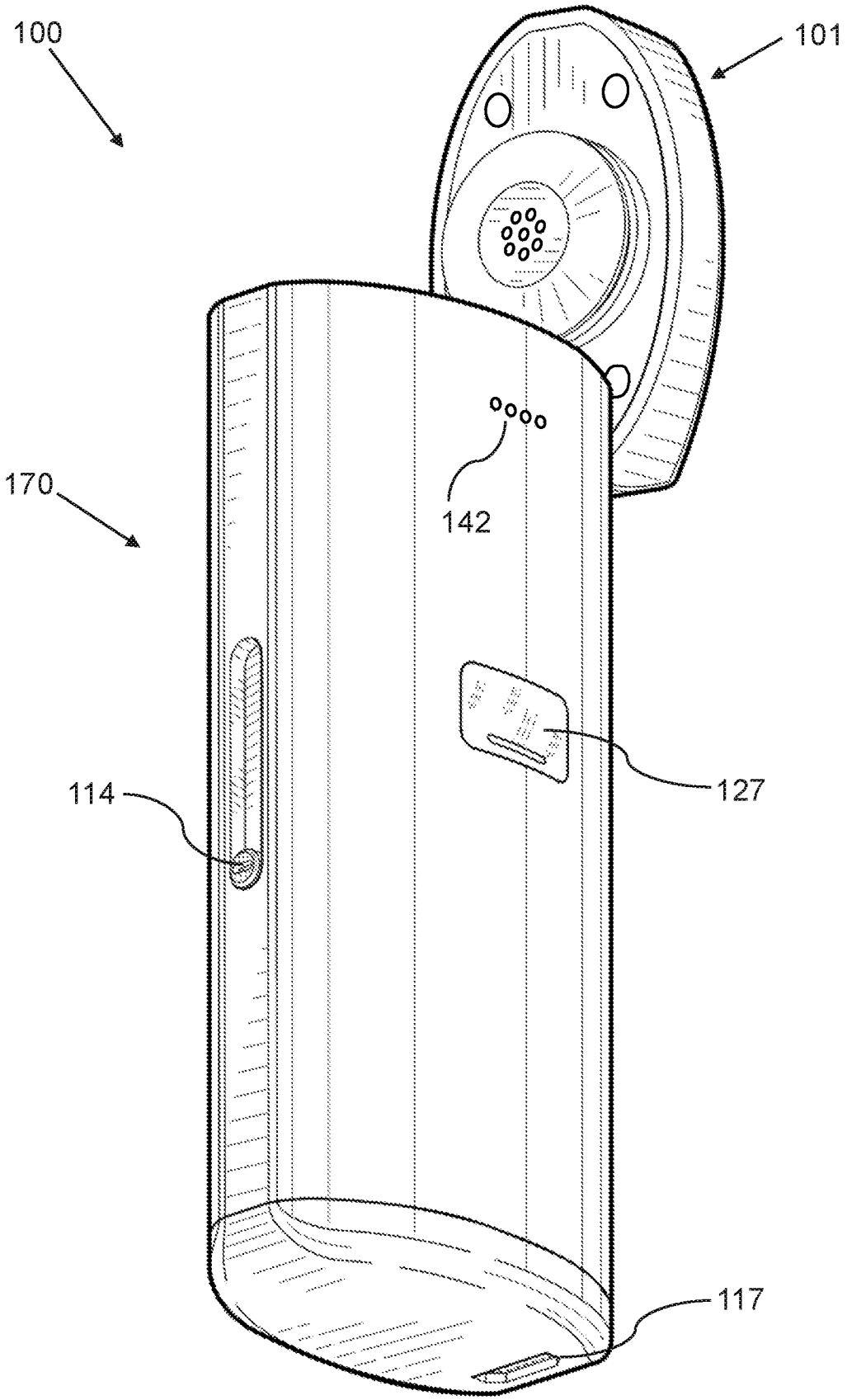
FIG. 2C is a bottom perspective view of a vaping device with a mouthpiece in an open configuration, according to an embodiment of the invention.
Figure 2D:
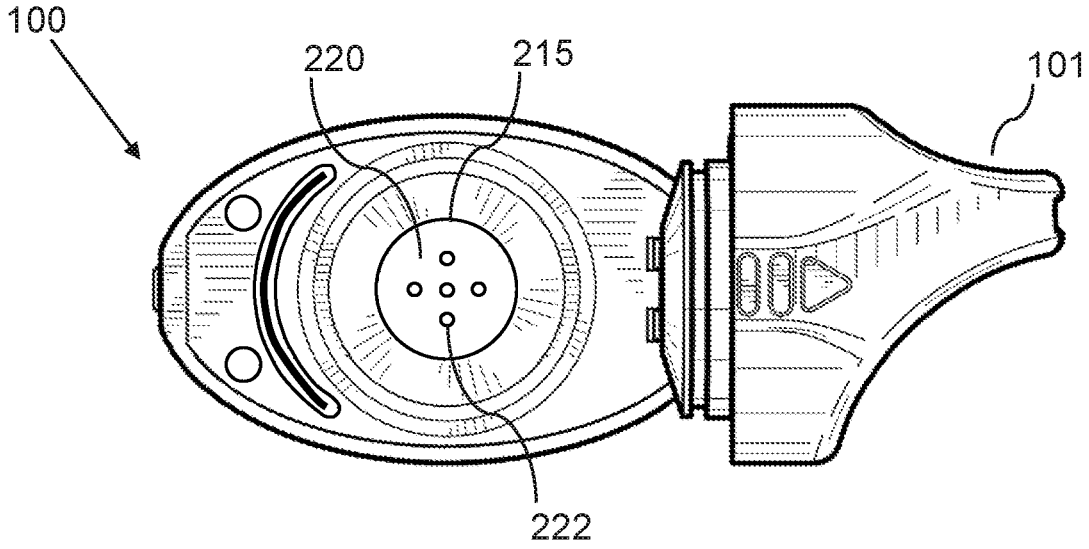
FIG. 2D is a top view of a vaping device with a mouthpiece in an open configuration, according to an embodiment of the invention.
Figure 2E:
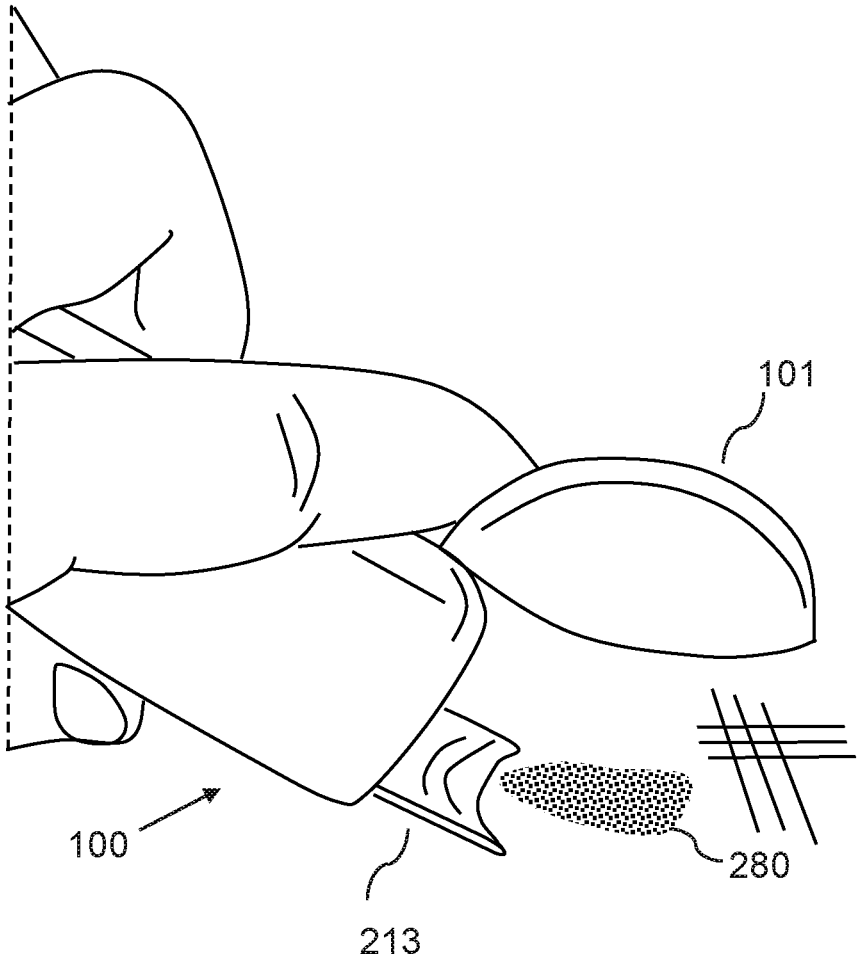
FIG. 2E is a side view showing use of a vaping device with a mouthpiece in an open configuration and a slidable shovel fully extended, according to an embodiment of the invention

In a related embodiment, as shown in FIGS. 2A, 2B, and 2E, the vaping device 100 can further include:

a) an herb loading shovel 213, which is slidably mounted in the main body 170;

such that the herb loading shovel 213 can slide into the main body 170, such that the herb loading shovel 213 is hidden in the main body 170; and such that the herb loading shovel 213 can slide out of the main body 170, such that the herb loading shovel 213 aids in shoveling the herb material 280 into the heating chamber, when the mouthpiece 101 is open and the loading shovel 213 is fully extended.

Figure 1B:
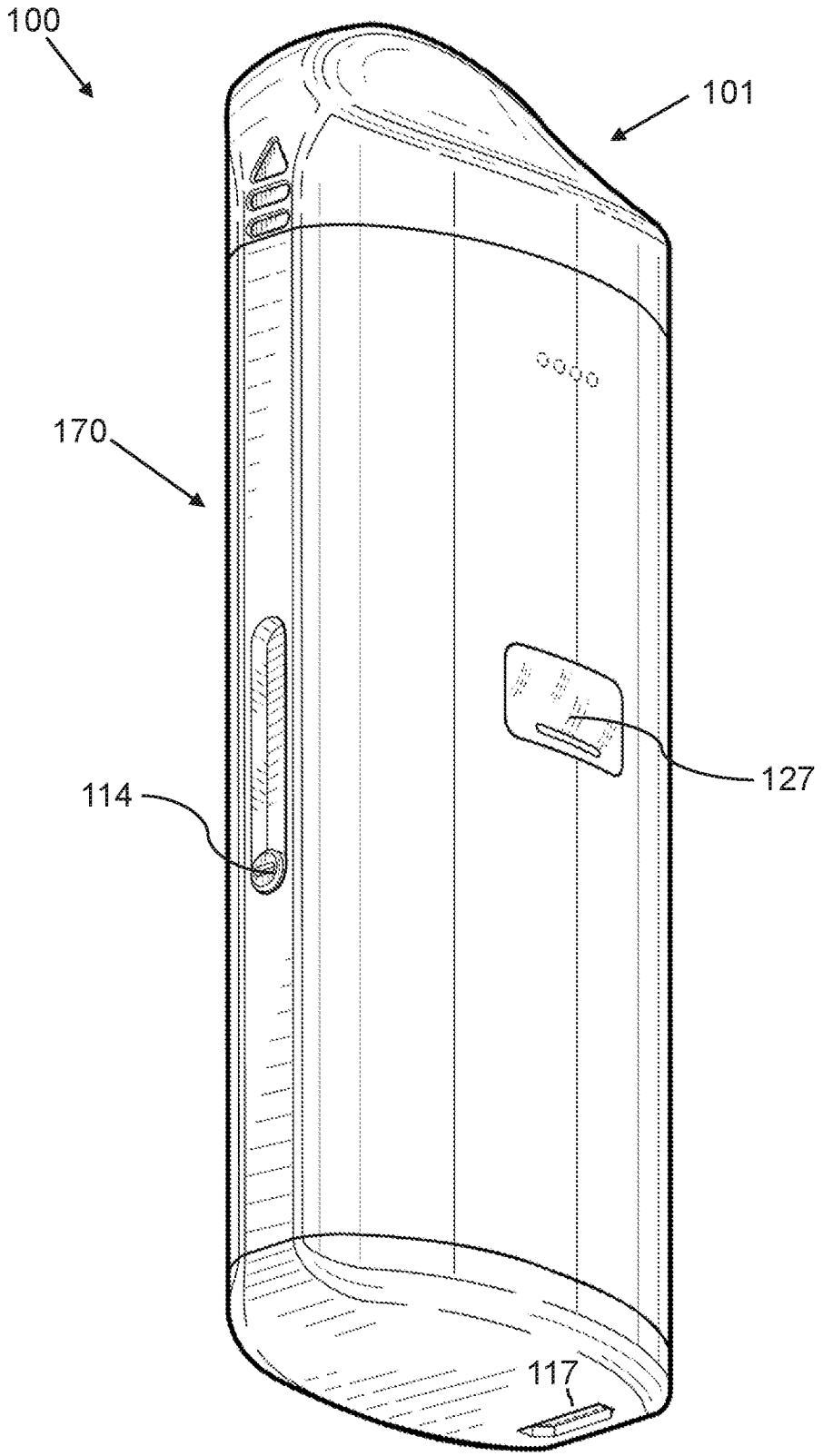
FIG. 1B is a bottom perspective view of a vaping device with a mouthpiece in a closed configuration, according to an embodiment of the invention.
Figure 1C:
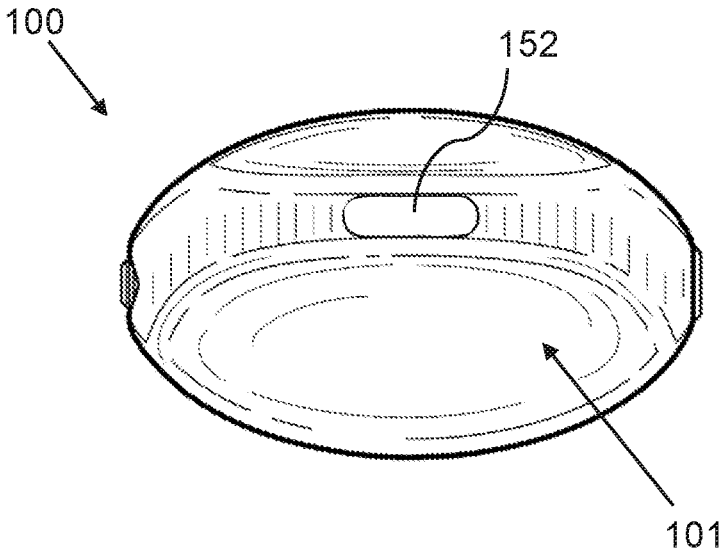
FIG. 1C is a top view of a vaping device with a dispensing spout in a closed configuration, according to an embodiment of the invention.

In a related embodiment, as shown in FIG. 1B, the herb loading shovel 213, can further include:

a) a sliding knob 128, which is connected to an outer side of the herb loading shovel 213;

wherein the main body 170 further comprises an elongated aperture 172, such that the sliding knob 128 protrudes through the elongated aperture 172, such that the sliding knob 128 is accessible on an external surface of the main body 170; such that the herb loading shovel 213 moves out 382 and in 384, when the sliding knob 128 is moved up 182 and down 184, respectively.

In conventional vaping devices, usually loading a herb in a vaporizer chamber requires careful loading of small pinches of herb, whereas the vaping device 100 herb loading shovel allows a user to simply scoop the herb in, such that the heating chamber 215 can be loaded with one hand when the herb material is located externally, such as in a bag, tray, table or box.

Figure 5A:
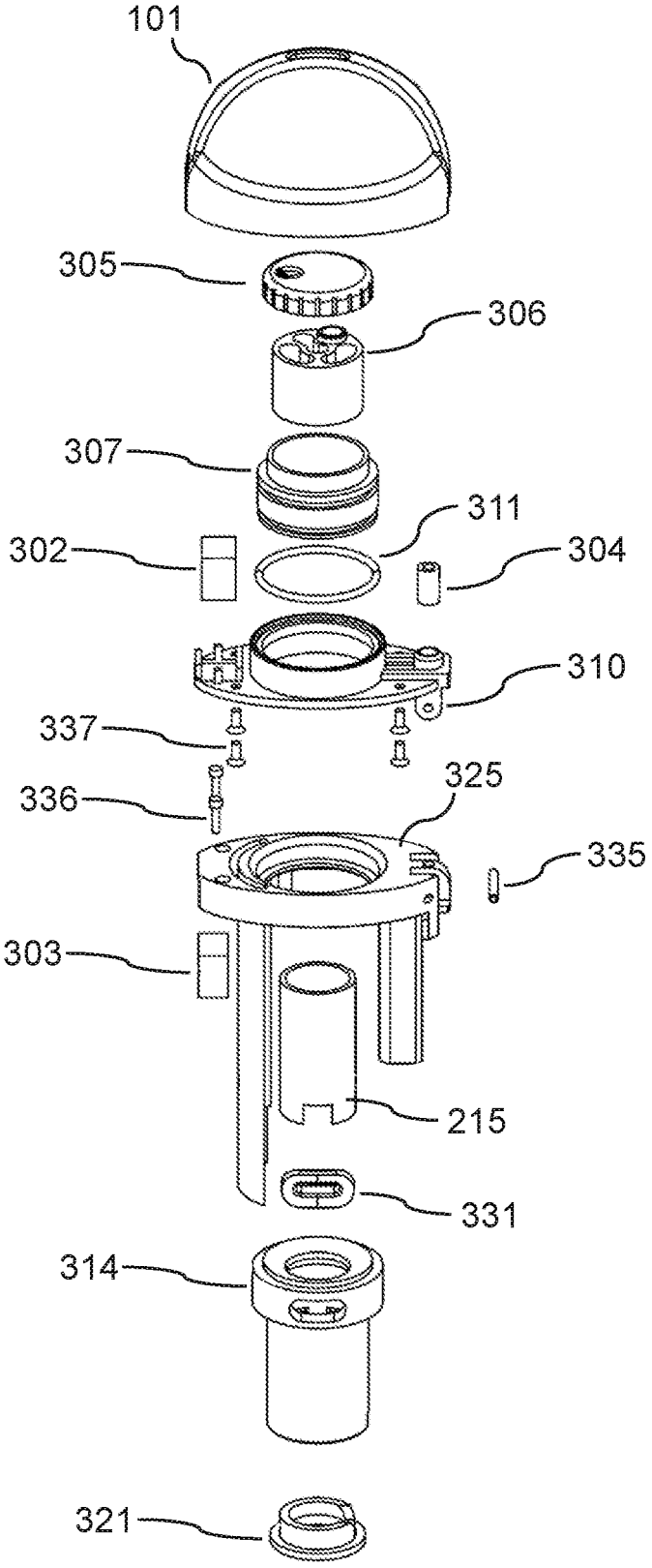
FIG. 5A is an exploded right top perspective view of a first set of parts of a vaping device, according to an embodiment of the invention.
Figure 5B:
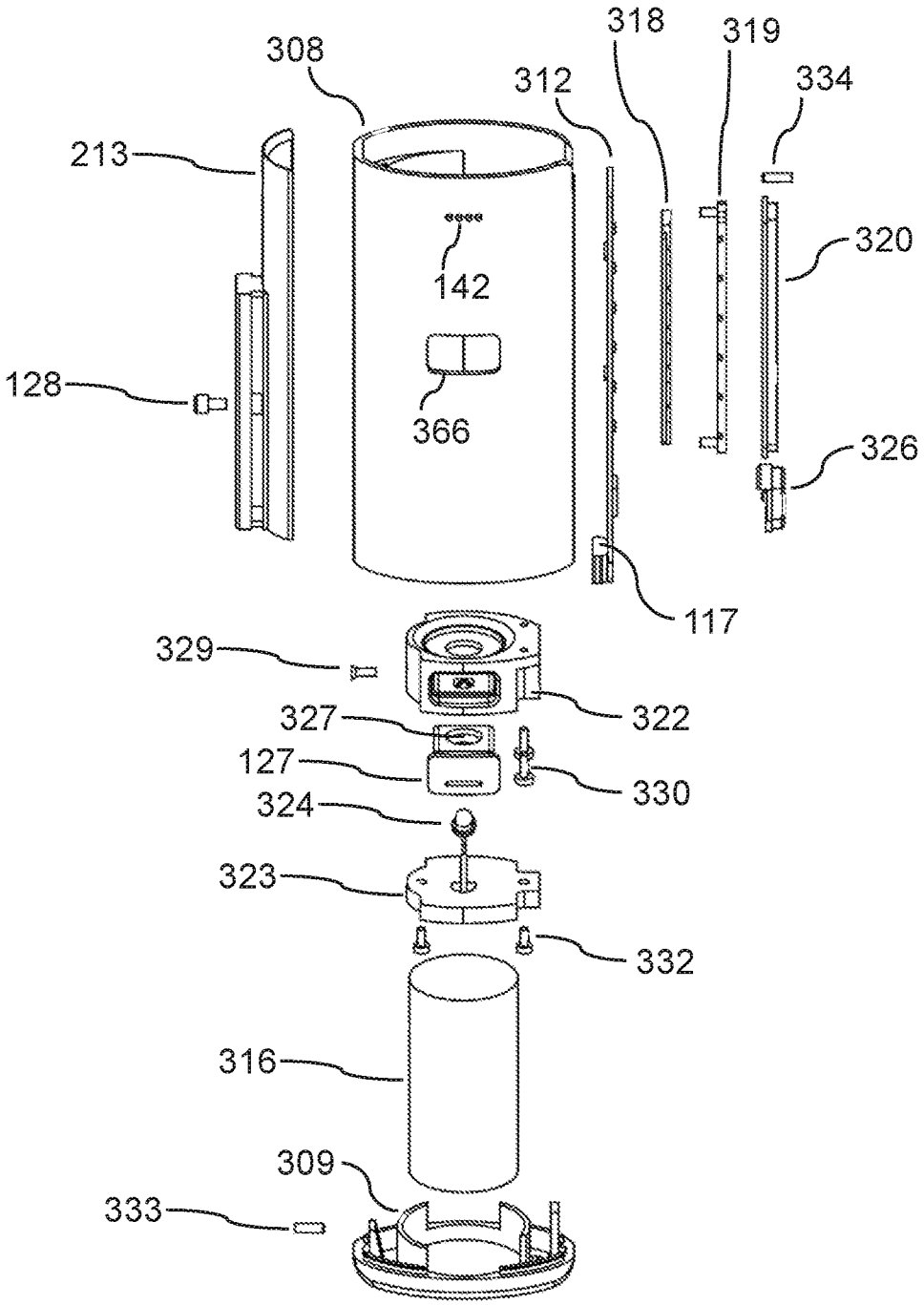
FIG. 5B is an exploded right top perspective view of a second set of parts of a vaping device, according to an embodiment of the invention.
Figure 5C:
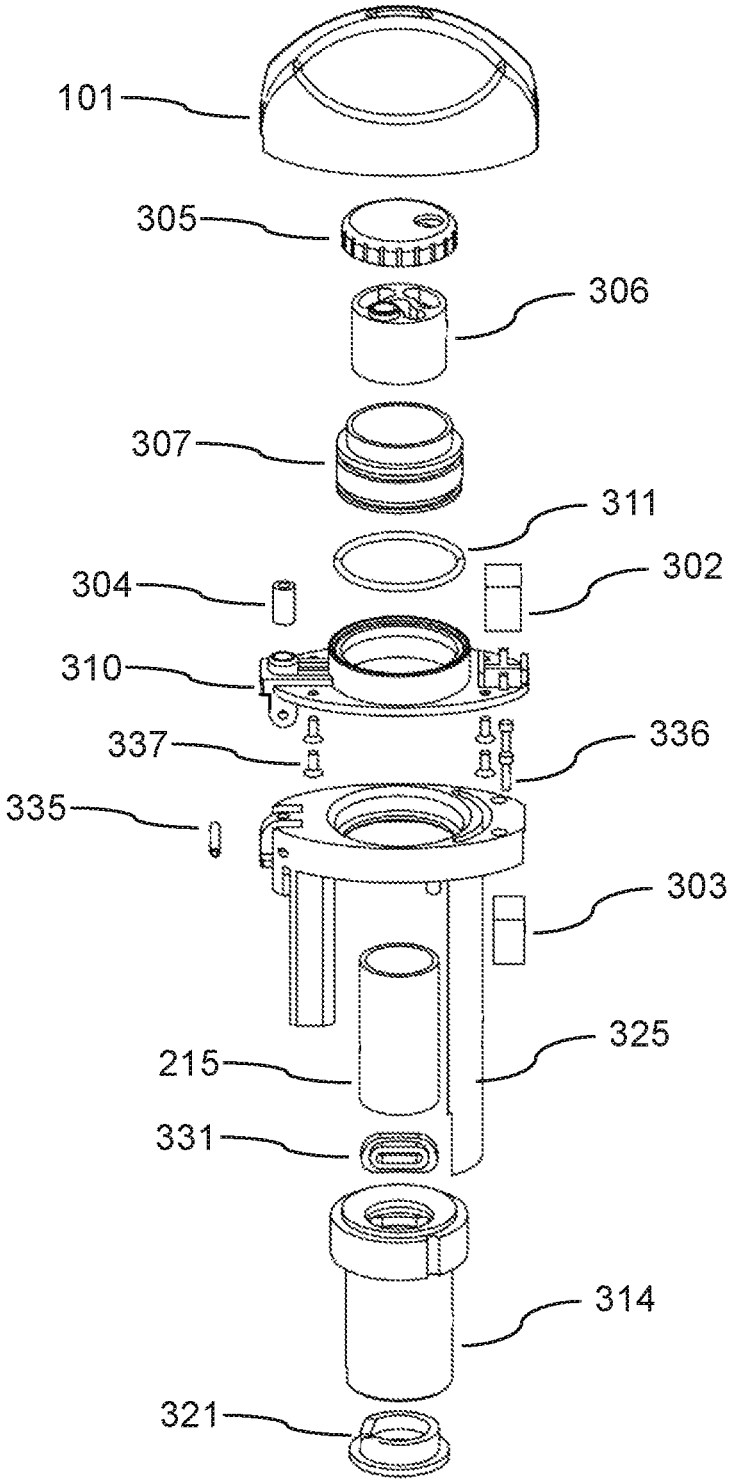
FIG. 5C is an exploded left bottom perspective view of a first set of parts of a vaping device, according to an embodiment of the invention.
Figure 5D:
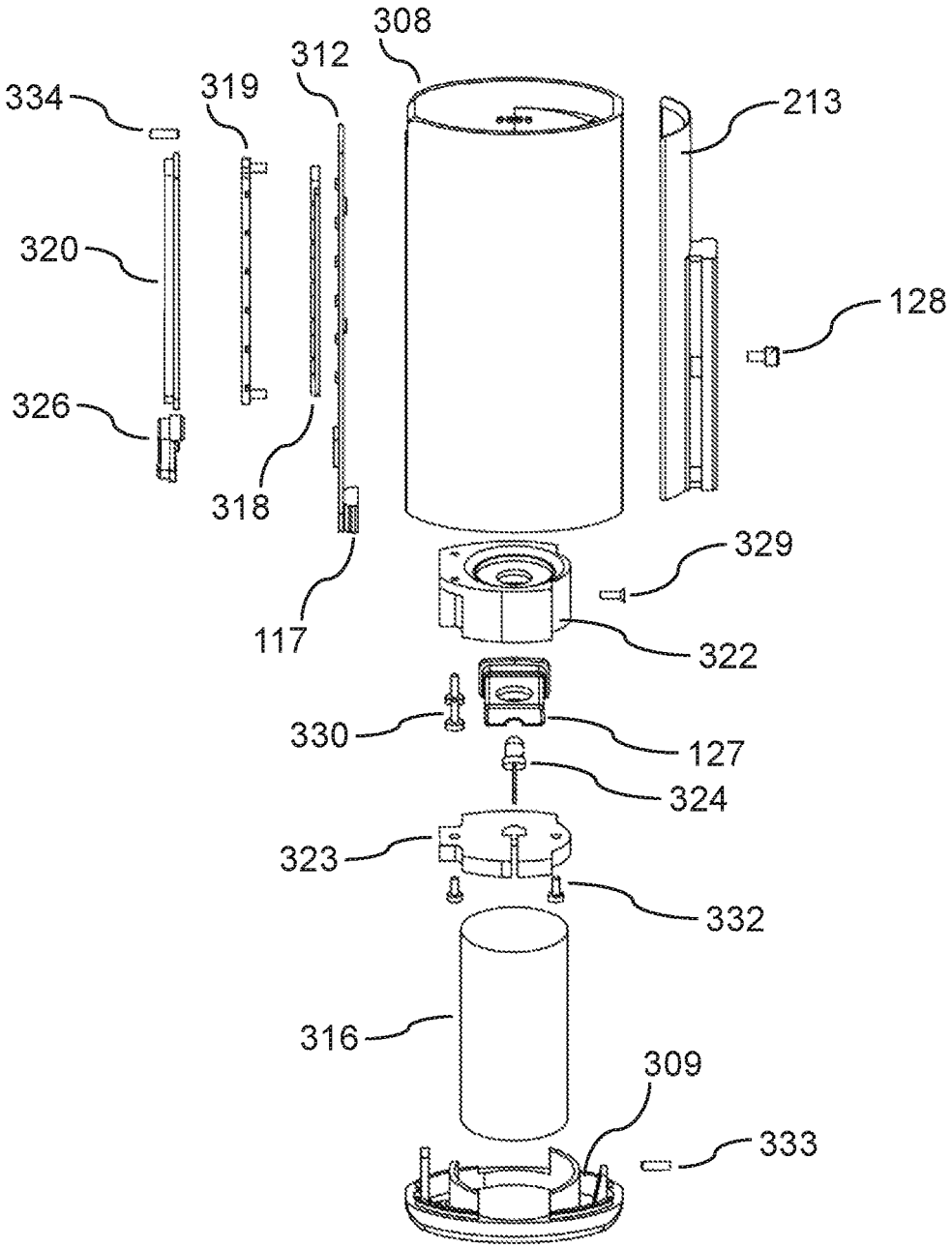
FIG. 5D is an exploded left bottom perspective view of a second set of parts of a vaping device, according to an embodiment of the invention.
Figure 6A:
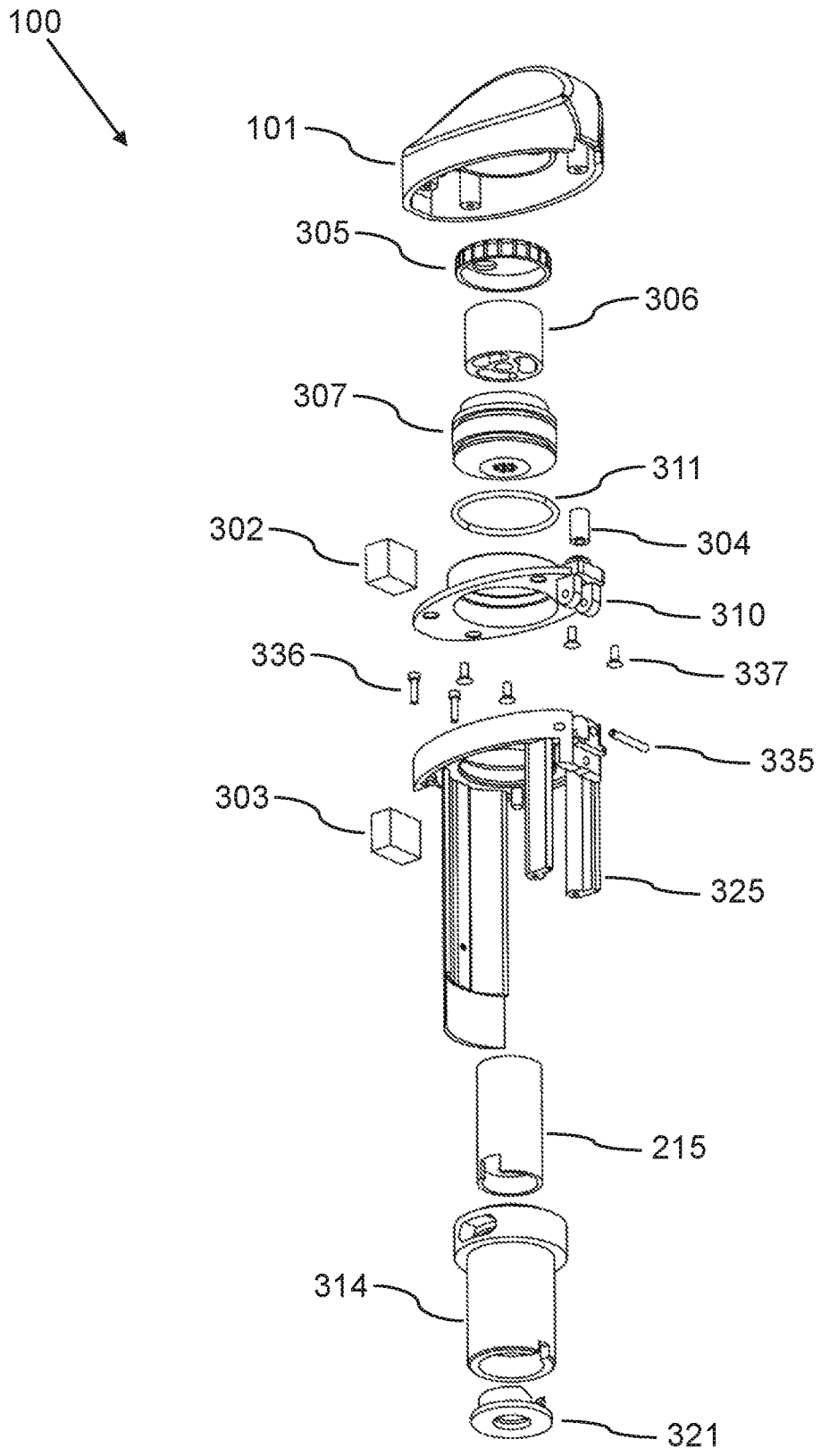
FIG. 6A is an exploded right bottom perspective view of a first set of parts of a vaping device, according to an embodiment of the invention.
Figure 6B:
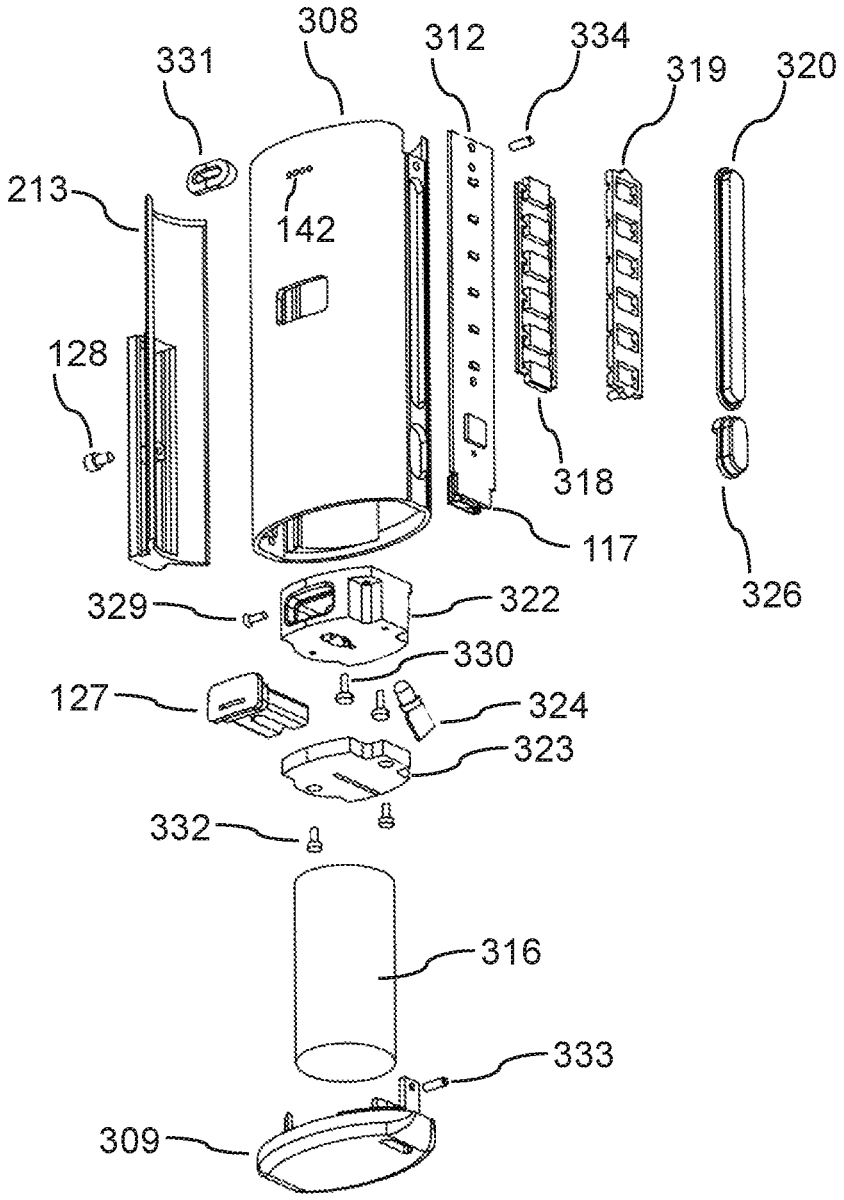
FIG. 6B is an exploded right bottom perspective view of a second set of parts of a vaping device, according to an embodiment of the invention.

In further related embodiment, as shown in FIGS. 1A, 7A, and 7B, the vaping device 100 can further include:

a) a residue tray 127, which includes an open residue container 327, such that the residue tray 127 can be removably and vertically slidably mounted below the heating chamber 215, such that an external surface of the main body comprises a residue aperture 366, as shown in FIGS. 3 and 5B, such that the residue tray 127 can slide into the residue aperture 366; such that the open residue container 327 is mounted below the heating chamber 215, when the residue tray is inserted into the residue aperture 366, such that residual material 782 can fall (i.e. falls) from the heating chamber into the open residue container 327; such that the residue tray 127 can be removed for cleaning (i.e. is removable for cleaning), to remove residual fragments and oily residue.

In further related embodiment, as shown in FIGS. 2D, 7A, and 7B, the vaping device 100 can further include:

a) a chamber floor 220, which is mounted on a bottom of the heating chamber 215, wherein the chamber floor 220 further comprises at least one chamber aperture 222;

such that the heating chamber 215 and the chamber floor 220 contain the herb material 280; and such that that the residual material 782 can fall through the at least one chamber aperture 222 into the open residue container 327.

In a related embodiment, the vapor cooler can be configured to be removable when the mouthpiece 101 is opened, such that the vapor cooler 306 can be pulled out from the vapor canal, cleaned, and then reinserted into the vapor canal. The vapor cooler can be configured as a screw that screws into the vapor canal or it can be configured to slide in, as an insertable plug.

In a related embodiment, the herb material 280 can be processed tobacco leaves, cannabis flowers or other cannabis materials, or some other form of smokable plant or herb material.

In a related embodiment, as shown in FIGS. 3, 4, 5A, 5B, 5C, and 7A-7B, the vaping device 100 can include the following parts:

a) A mouthpiece cover 101;
b) A mouthpiece magnet 302;
c) A body magnet 303;
d) A screw 304;
e) A stainless steel cover for vapor cooling chamber 305;
f) A vapor cooling silicone ring 306;
g) A vapor cooling chamber 307;
h) An aluminum body cover 308;
i) A bottom cover 309;
j) A mouthpiece bottom body 310;
k) An o ring—silicone 311;
l) A display pcb 312;
m) A sliding shovel 213;
n) A ceramic heating chamber cover 314;
o) A ceramic heating chamber 215;
p) A battery 316;
q) A charging port 117, which can be an USB port 117;
r) A display light silicone 318;
s) A display light cover 319;
t) A display mirror 320;
u) A ceramic chamber bottom 321;
v) A ceramic chamber stabilizer top 322;
w) A ceramic chamber stabilizer bottom 323;
x) A logo light 324;
y) A body stabilizer 325;
z) A button 326;
aa) A residue tray 127;
bb) A residue container 327;
cc) A sliding shovel nail/knob 128;
dd) A bottom cover screw 329;
ee) A bottom cover screw 330;
ff) An air intake silicone 331;
gg) A bottom cover screw 332;
hh) A bottom cover nail 333;
ii) A display pcb nail 334;
jj) A mouthpiece nail 335;
kk) A main body stabilizer screw 336; and
ll) A mouthpiece screw 337.

Figure 8:
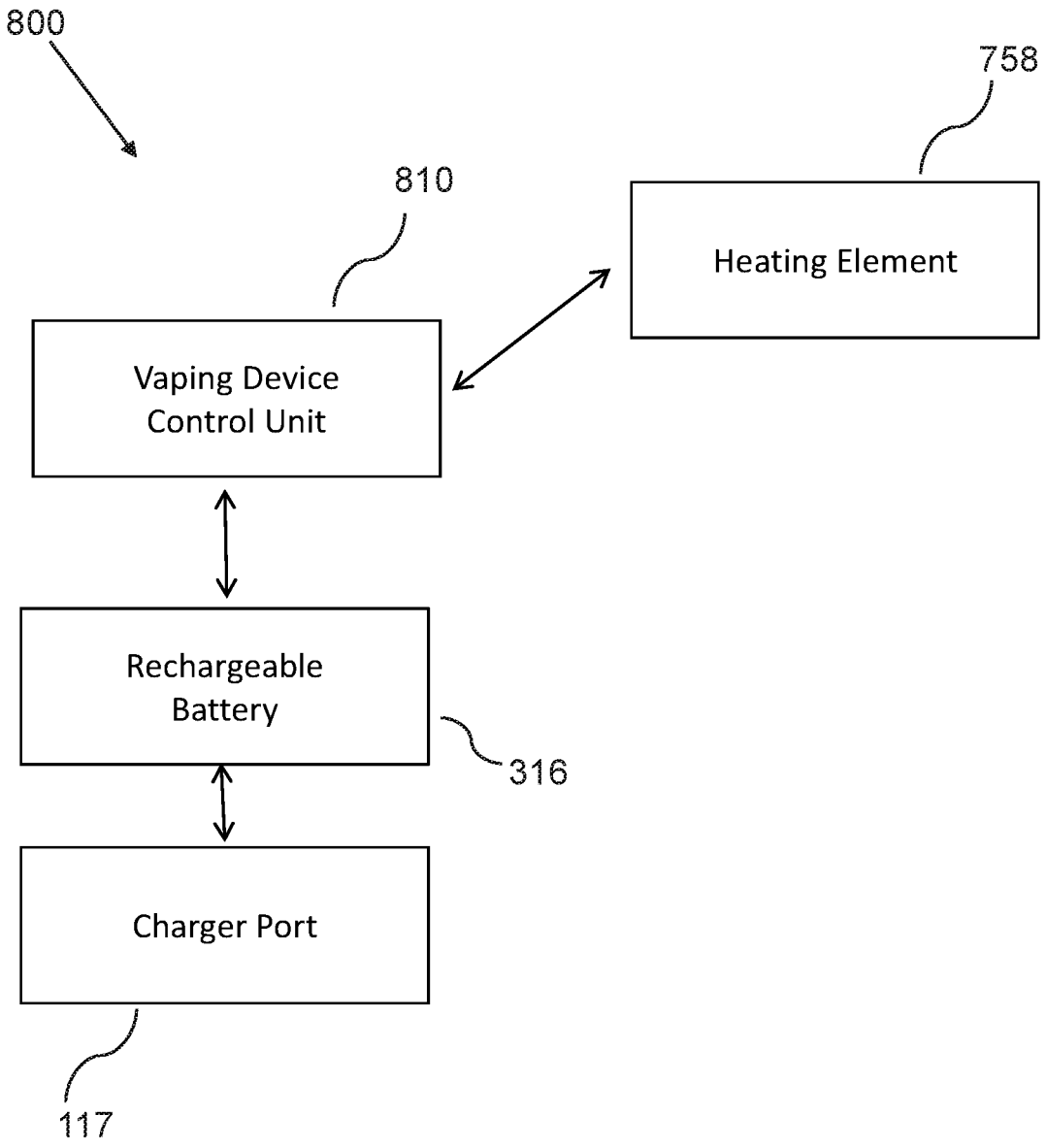
FIG. 8 is a schematic diagram illustrating a vaping device control system, according to an embodiment of the invention.

In a related embodiment, as shown in FIG. 8, a vaping device control system 800 can include:

a) A vaping device control unit 810;

b) A heating element 758;

c) A rechargeable battery 316; and d) A charging port 117.

Figure 9:
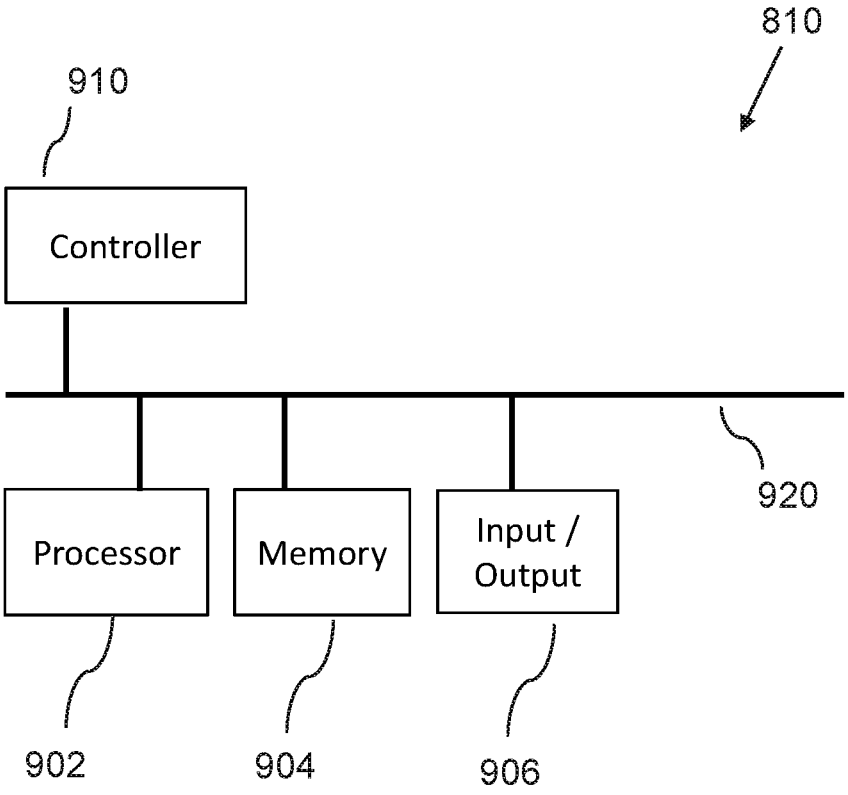
FIG. 9 is a schematic diagram illustrating a vaping device control unit, according to an embodiment of the invention.

In a related embodiment, as shown in FIG. 9, the vaping device control unit 810 can include:

a) A processor 902;

b) A non-transitory memory 904;

c) An input/output component 906;

d) A controller 910, which is configured to control functions of the vaping device control system 800; all connected via e) A data bus 920.

FIGS. 8 and 9 are block diagrams and flowcharts, methods, devices, systems, apparatuses, and computer program products according to various embodiments of the present invention. It shall be understood that each block or step of the block diagram, flowchart and control flow illustrations, and combinations of blocks in the block diagram, flowchart and control flow illustrations, can be implemented by computer program instructions or other means. Although computer program instructions are discussed, an apparatus or system according to the present invention can include other means, such as hardware or some combination of hardware and software, including one or more processors or controllers, for performing the disclosed functions.

In this regard, FIGS. 8 and 9 depict the computer devices of various embodiments, each containing several of the key components of a general-purpose computer by which an embodiment of the present invention may be implemented. Those of ordinary skill in the art will appreciate that a computer can include many components. However, it is not necessary that all of these generally conventional components be shown in order to disclose an illustrative embodiment for practicing the invention. The general-purpose computer can include a processing unit and a system memory, which may include various forms of non-transitory storage media such as random access memory (RAM) and read-only memory (ROM). The computer also may include nonvolatile storage memory, such as a hard disk drive, where additional data can be stored.

It shall be understood that the above-mentioned components of the vaping device control unit 810 are to be interpreted in the most general manner.

For example, the processor 902 can include a single physical microprocessor or a microcontroller.

In a further example, the non-transitory memory 904 can include various forms of non-transitory storage media, including random access memory and other forms of dynamic storage, and hard disks. Similarly, the input/output 906 can each respectively include a plurality of well-known input/output devices, such as screens, keyboards, pointing devices, motion trackers, communication ports, and so forth.

Furthermore, it shall be understood that the vaping device control unit 810 can include a number of other components that are well known in the art of general computer devices, and therefore shall not be further described herein. This can include system access to common functions and hardware, such as for example via operating system layers such as WINDOWS™, LINUX™, and similar operating system software, but can also include configurations wherein application services are executing directly on server hardware or via a hardware abstraction layer other than a complete operating system.

An embodiment of the present invention can also include one or more input or output components, such as a mouse, keyboard, monitor, and the like. A display can be provided for viewing text and graphical data, as well as a user interface to allow a user to request specific operations. Furthermore, an embodiment of the present invention may be connected to one or more remote computers via a network interface. The connection may be over a local area network (LAN) wide area network (WAN), and can include all of the necessary circuitry for such a connection.

In a related embodiment, the vaping device control unit 810 can communicates with external mobile devices over a network, which can include the general Internet, a Wide Area Network or a Local Area Network, or another form of communication network, transmitted on wired or wireless connections. Wireless networks can for example include Ethernet, Wi-Fi, BLUETOOTH™, ZIGBEE™, and NFC. The communication can be transferred via a secure, encrypted communication protocol.

Typically, computer program instructions may be loaded onto the computer or other general-purpose programmable machine to produce a specialized machine, such that the instructions that execute on the computer or other programmable machine create means for implementing the functions specified in the block diagrams, schematic diagrams or flowcharts. Such computer program instructions may also be stored in a computer-readable medium that when loaded into a computer or other programmable machine can direct the machine to function in a particular manner, such that the instructions stored in the computer-readable medium produce an article of manufacture including instruction means that implement the function specified in the block diagrams, schematic diagrams or flowcharts.

In addition, the computer program instructions may be loaded into a computer or other programmable machine to cause a series of operational steps to be performed by the computer or other programmable machine to produce a computer-implemented process, such that the instructions that execute on the computer or other programmable machine provide steps for implementing the functions specified in the block diagram, schematic diagram, flowchart block or step.

Accordingly, blocks or steps of the block diagram, flowchart or control flow illustrations support combinations of means for performing the specified functions, combinations of steps for performing the specified functions and program instruction means for performing the specified functions. It will also be understood that each block or step of the block diagrams, schematic diagrams or flowcharts, as well as combinations of blocks or steps, can be implemented by special purpose hardware-based computer systems, or combinations of special purpose hardware and computer instructions, that perform the specified functions or steps.

As an example, provided for purposes of illustration only, a data input software tool of a search engine application can be a representative means for receiving a query including one or more search terms. Similar software tools of applications, or implementations of embodiments of the present invention, can be means for performing the specified functions. For example, an embodiment of the present invention may include computer software for interfacing a processing element with a user-controlled input device, such as a mouse, keyboard, touch screen display, scanner, or the like. Similarly, an output of an embodiment of the present invention may include, for example, a combination of display software, video card hardware, and display hardware. A processing element may include, for example, a controller or microprocessor, such as a central processing unit (CPU), arithmetic logic unit (ALU), or control unit.

Here has thus been described a multitude of embodiments of the vaping device 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A vaping device, comprising: a main body, which comprises: a heating chamber, which comprises a heating element, such that a herb material is insertable into a heating interior of the heating chamber, such that the herb material is heated by the heating element, such that a vapor is produced by the herb material, and such that an external surface of the heating chamber is heated by the heating element; an air entry aperture, which is positioned on a surface of the main body; a heating canal, which is connected in a first end to the air entry aperture and in a second end to the heating chamber, wherein the heating canal is helix-shaped, such that the heating canal is configured to spiral around the heating chamber; an herb loading shovel, which is slidably mounted in the main body; wherein the herb loading shovel is mounted in an upper portion of the main body, such that the herb loading shovel is configured to slide into an upper surface of the main body directly adjacent to an upper opening of the heating chamber, such that the herb loading shovel is hidden in the main body; and such that the herb loading shovel is configured to slide out of the upper surface of the main body directly adjacent to the upper opening of the heating chamber, such that the herb loading shovel aids in shoveling the herb material into the heating chamber, when the herb loading shovel is fully extended; and a mouthpiece, which is hingedly connected to a top of the main body, wherein the mouthpiece comprises: a vapor exit aperture, which is positioned on a surface of the mouthpiece, such that the vapor exit aperture is fluidly connected to the heating interior of the heating chamber; a vapor canal, such that the vapor exit aperture is fluidly connected to the vapor canal, and such that the vapor canal is fluidly connected to the heating interior of the heating chamber; and a vapor cooler, which is positioned in the vapor canal, such that the vapor cooler is positioned within the mouthpiece, such that the vapor cooler comprises a cooling canal, such that the vapor from the heating chamber passes through the cooling canal, such that the cooling canal cools the vapor; such that air is configured to enter via the air entry aperture, pass through via the heating canal and the heating chamber, and exit via the vapor exit aperture; such that the air is heated from a convective heat emitted by the external surface of the heating chamber.

2. The vaping device of claim 1, wherein the vapor cooler is configured to be removable from the vapor canal, when the mouthpiece is opened.

3. The vaping device of claim 1, wherein the herb loading shovel further comprises: a sliding knob, which is connected to an outer side of the herb loading shovel; wherein the main body further comprises an elongated aperture; such that the sliding knob protrudes through the elongated aperture, such that the sliding knob is accessible on an external surface of the main body; such that the herb loading shovel moves out and in, when the sliding knob is moved up and down, respectively.

4. The vaping device of claim 1, further comprising:

a residue tray, which comprises an open residue container;

wherein an external surface of the main body comprises a residue aperture;

such that the residue tray is removably and vertically slidably mounted below the heating chamber, such that the residue tray is configured to slide into the residue aperture;

such that the open residue container is mounted below the heating chamber, when the residue tray is inserted into the residue aperture, such that residual material falls from the heating chamber into the open residue container;

such that the residue tray is removable for cleaning.

5. The vaping device of claim 4, further comprising:

a chamber floor, which is mounted on a bottom of the heating chamber, wherein the chamber floor further comprises at least one chamber aperture;

such that the heating chamber and the chamber floor are configured to contain the herb material; and such that that the residual material falls through the at least one chamber aperture into the open residue container.

6. The vaping device of claim 1, further comprising:

a heating chamber cover, which is configured to slide over the heating chamber, such that the heating chamber cover is adjacent to an outer vertical surface of the heating chamber and covers at least a part of the outer vertical surface of the heating chamber;

wherein an inner surface of the heating chamber cover comprises an indentation, such that the indentation forms the heating canal between the inner surface of the heating chamber cover and an outer surface of the heating chamber.

7. The vaping device of claim 6, wherein the inner surface of the heating chamber cover is tubular and shaped as an outer tube; and the outer surface of the heating chamber is tubular and shaped as an inner tube; such that the inner tube fits inside the outer tube.

8. The vaping device of claim 1, wherein the heating element is incorporated in a wall of the heating chamber.

9. A vaping device, comprising:

a main body, which comprises:

a heating chamber, which comprises a heating element, such that a herb material is insertable into a heating interior of the heating chamber, such that the herb material is heated by the heating element, such that a vapor is produced by the herb material, and such that an external surface of the heating chamber is heated by the heating element;

an air entry aperture, which is positioned on a surface of the main body; and a heating canal, which is connected in a first end to the air entry aperture and in a second end to the heating chamber, such that the heating canal is configured to extend along the external surface of the heating chamber;

an herb loading shovel, which is slidably mounted in the main body; and a vapor exit aperture, which is positioned on a surface of the vaping device, such that the vapor exit aperture is fluidly connected to the heating interior of the heating chamber;

wherein the herb loading shovel is mounted in an upper portion of the main body, such that the herb loading shovel is configured to slide into an upper surface of the main body directly adjacent to an upper opening of the heating chamber, such that the herb loading shovel is hidden in the main body; and such that the herb loading shovel is configured to slide out of the upper surface of the main body directly adjacent to the upper opening of the heating chamber, such that the herb loading shovel aids in shoveling the herb material into the heating chamber, when the herb loading shovel is fully extended;

such that air is configured to enter via the air entry aperture, pass through via the heating canal and the heating chamber, and exit via the vapor exit aperture;

such that the air is heated from a convective heat emitted by the external surface of the heating chamber.

10. The vaping device of claim 9, wherein the heating canal is helix-shaped, such that the heating canal is configured to spiral around the heating chamber.

11. The vaping device of claim 9, further comprising:

a mouthpiece, which is hingedly connected to a top of the main body, wherein the mouthpiece comprises:

the vapor exit aperture, which is positioned on the surface of the mouthpiece; and a vapor canal, such that the vapor exit aperture is fluidly connected to the vapor canal, and such that the vapor canal is fluidly connected to the heating interior of the heating chamber.

12. The vaping device of claim 11, wherein the mouthpiece further comprises:

a vapor cooler, which is positioned in the vapor canal, such that the vapor cooler is positioned within the mouthpiece, such that the vapor cooler comprises a cooling canal, such that the vapor from the heating chamber passes through the cooling canal, such that the cooling canal cools the vapor.

13. The vaping device of claim 9, wherein the herb loading shovel further comprises:

a sliding knob, which is connected to an outer side of the herb loading shovel;

wherein the main body further comprises an elongated aperture;

such that the sliding knob protrudes through the elongated aperture, such that the sliding knob is accessible on an external surface of the main body; such that the herb loading shovel moves out and in, when the sliding knob is moved up and down, respectively.

14. The vaping device of claim 9, further comprising:

a residue tray, which comprises an open residue container;

wherein an external surface of the main body comprises a residue aperture;

such that the residue tray is removably and vertically slidably mounted below the heating chamber, such that the residue tray is configured to slide into the residue aperture;

such that the open residue container is mounted below the heating chamber, when the residue tray is inserted into the residue aperture, such that residual material falls from the heating chamber into the open residue container;

such that the residue tray is removable for cleaning.

15. The vaping device of claim 9, further comprising:

a heating chamber cover, which is configured to slide over the heating chamber, such that the heating chamber cover is adjacent to an outer vertical surface of the heating chamber and covers at least a part of the outer vertical surface of the heating chamber;

wherein an inner surface of the heating chamber cover comprises an indentation, such that the indentation forms the heating canal between the inner surface of the heating chamber cover and an outer surface of the heating chamber.

16. The vaping device of claim 15, wherein the inner surface of the heating chamber cover is tubular and shaped as an outer tube; and the outer surface of the heating chamber is tubular and shaped as an inner tube; such that the inner tube fits inside the outer tube.

17. A vaping device, comprising: a main body, which comprises: a heating chamber, which comprises a heating element, such that a herb material is insertable into a heating interior of the heating chamber, such that the herb material is heated by the heating element, such that a vapor is produced by the herb material, and such that an external surface of the heating chamber is heated by the heating element; an air entry aperture, which is positioned on a surface of the main body; a heating canal, which is connected in a first end to the air entry aperture and in a second end to the heating chamber, wherein the heating canal is configured to spiral around the heating chamber; an herb loading shovel, which is slidably mounted in the main body; wherein the herb loading shovel is mounted in an upper portion of the main body, such that the herb loading shovel is configured to slide into an upper surface of the main body directly adjacent to an upper opening of the heating chamber, such that the herb loading shovel is hidden in the main body; and such that the herb loading shovel is configured to slide out of the upper surface of the main body directly adjacent to the upper opening of the heating chamber, such that the herb loading shovel aids in shoveling the herb material into the heating chamber, when the herb loading shovel is fully extended; and a mouthpiece, which is connected to a top of the main body, wherein the mouthpiece comprises: a vapor exit aperture, which is positioned on a surface of the mouthpiece, such that the vapor exit aperture is fluidly connected to the heating interior of the heating chamber; a vapor canal, such that the vapor exit aperture is fluidly connected to the vapor canal, and such that the vapor canal is fluidly connected to the heating interior of the heating chamber; and a vapor cooler, which is positioned in the vapor canal, such that the vapor cooler is positioned within the mouthpiece, such that the vapor cooler comprises a cooling canal, such that the vapor from the heating chamber passes through the cooling canal, such that the cooling canal cools the vapor; such that air is configured to enter via the air entry aperture, pass through via the heating canal and the heating chamber, and exit via the vapor exit aperture; such that the air is heated from a convective heat emitted by the external surface of the heating chamber.

18. The vaping device of claim 17, wherein the herb loading shovel further comprises: a sliding knob, which is connected to an outer side of the herb loading shovel; wherein the main body further comprises an elongated aperture; such that the sliding knob protrudes through the elongated aperture, such that the sliding knob is accessible on an external surface of the main body; such that the herb loading shovel moves out and in, when the sliding knob is moved up and down, respectively.

* * * * *